United States Patent [19]

Forbes et al.

[11] 3,945,213

[45] Mar. 23, 1976

[54] SUBSEA WELLHEAD SHIELDING AND SHOCK MITIGATING SYSTEM

[75] Inventors: Gordon B. Forbes, San Jose; Roland W. Van Houten, Palo Alto, both of Calif.

[73] Assignee: Subsea Equipment Associates Ltd., Hamilton, Bermuda

[22] Filed: May 8, 1974

[21] Appl. No.: 467,878

[52] U.S. Cl. ..... 61/69 R; 61/46; 166/.5

[51] Int. Cl.[2] ..... B63C 11/00

[58] Field of Search ..... 61/69, 46, 46.5; 166/.5, 166/.6; 173/162; 285/18, 23, 24, 27, 140; 267/136, 137, 138, 125

[56] References Cited

UNITED STATES PATENTS

| | | | |
|---|---|---|---|
| 2,019,964 | 11/1935 | Hamerly | 173/162 |
| 2,110,395 | 3/1938 | Fluor et al. | 285/140 X |
| 2,962,096 | 11/1960 | Knox | 285/18 X |
| 2,962,304 | 11/1960 | Lung | 285/140 X |
| 3,008,703 | 11/1961 | Slemmons et al. | 267/136 UX |
| 3,485,056 | 12/1969 | Helmus | 61/69 R |
| 3,512,583 | 5/1970 | James | 166/.5 |
| 3,587,734 | 6/1971 | Shaffer | 166/.5 |
| 3,602,301 | 8/1971 | James | 166/.6 |
| 3,744,561 | 7/1973 | Shatto et al. | 166/.5 |

*Primary Examiner*—Dennis L. Taylor
*Attorney, Agent, or Firm*—Ernest F. Marmorek

[57] ABSTRACT

Apparatus is disclosed for shielding subsea wellheads from shock loads due to accidental impact due to the landing of retrieval gear. The present invention shields the wellhead from vertical impact loads by means of a generally conical outer structure and utilizes a shock absorbing material between a portion of the outer structure and the wellhead to minimize lateral impact loads. The total structure comprising the present invention completely surrounds the wellhead extension and provides a flexible, energy absorbing structure to protect the wellhead from the impact loads. More specifically the present invention provides supporting guide structure which is rigidly mounted on the wellhead. The supporting guide structure provides means for transmitting the impact loads to the wellheads. Resilient material that exhibits high damping characteristics and which is compatible with a subsea environment is used for absorbing shocks so as to reduce the lateral impact forces sufficiently to prevent failure of the wellhead. The present invention is particularly advantageous for reducing the possibility of oil spill by affording protection to the subsea wellheads.

6 Claims, 5 Drawing Figures

SUBSEA WELLHEAD SHIELDING AND SHOCK MITIGATING SYSTEM

BACKGROUND OF THE INVENTION

1. Field of the Invention

This invention relates generally to oil wells and more particularly to means for shielding a subsea wellhead and for mitigating impact loads applied thereto.

2. Description of the Prior Art

In the art of recovering oil from a subterraneous formation, various methods of geophysical exploration are employed. In the drilling of a well, either of two common systems may be employed. The first system utilizes cable tool drilling in which a heavy drilling bit which may be many feet in length is moved up and then is allowed to drop so as to produce the hole by displacement. The cuttings are then bailed out after periodical sinking of the hole. In a second or "rotary" system, an enlarged bit at the end of a drill stem or drill pipe is rotated while it is let down in the hole to be formed. A drilling fluid is pumped down in the drill pipe. The drilling fluid is passed through holes or eyes in the bit and then rises outside of the drill pipe to the surface carrying the cuttings with it. These cuttings are then separated from the "mud" or fluid by gravity separation along a settling ditch or passed over a screen or both. The drilling fluid then proceeds to a sump for recirculation.

In the cable tool system described hereinabove a drilling fluid may also be employed. The drilling fluid performs a number of functions such as carrying the cuttings to the surface as described above and also lining the bore hole by a filtering action of the liquid part of the fluid in the bore wall. Where an aqueous fluid is employed in order to give it body, various solids may be used. In order impart specific gravity to the drilling fluid, a heavy material such as barytes may be used. To control the viscosity of the drilling fluid a polyphosphate may be used. When the liquid part of the drilling fluid is oil, such as fuel oil, various viscosity imparting agents and barytes may be employed.

During the course of drilling, the bore hole is cased at various stages in the sinking of the well. The casing operation is performed by a steel casing being let down into the hole. The steel casing is cemented in place to shut off water formations and to prevent caving. There may be a number of "strings" of casings in a well.

To complete the well for production, the drilling fluid is bailed out of the well leaving a coating of clay, etc. on the bore walls which then must be removed at the producing formation. To accomplish this the well may be "swabbed" by letting down a swabbing tool which will take off the drilling fluid solid from the bore hole at the producing formation. Another method for completing the well for production is to employ acid together with a corrosion inhibitor. Still another method for completing the well for production is to apply shots of nitroglycerine. The formation may then be expanded at the producing formation by a suitable expanding instrument.

The bottom of the hole is then provided with a "gravel pack" and this may be partially done before the screen leading to the tubing is let down into the well. This tubing is smaller than the well bore including the casings and, where the pressure is not sufficient to cause the well to flow to the top, a pump cylinder and a piston are provided proximate the bottom of the well.

Below the pump cylinder and piston is a screen around which gravel may be packed. The piston is provided with a pump rod which extends to the top of the well and is connected to a suitable pumping mechanism although in some cases gas and airlifts are used. The tubing passes through a cap which is called a "casing head" that is provided with a packing around the tubing. The tubing itself is also provided with a cap which may be packed around the pump rod. Extending from the tubing is the flow line which is a pipe or series of pipes leading from the tubing to the storage means.

In prior art subsea wellhead installations guidelines were used for guiding the package which defines the impacting loads so that, optimumly, the package landed axially on the wellhead. However, due to water currents, the weight of the material being landed and other external forces, axial landing on the wellhead landing surface could not be assured so that when the package did land on the wellhead, damage thereto was sustained.

SUMMARY OF THE INVENTION

The present invention overcomes the above-noted shortcoming of the prior art by providing a supporting guide structure that is rigidly mounted on the wellhead. In one embodiment of this invention the guide structure is at least partially conical. The supporting guide structure provides means for transmitting the impact loads to the wellhead. Resilient material which exhibits high damping characteristics and which is compatible with a subsea environment is used for shock absorbing purposes. In the embodiment illustrated blocks of neoprene impregnated canvas laminations are used. The shock absorbing blocks may be cylindrical or rectangular in shape and serve to reduce the impact forces sufficiently so as to prevent failrue of the wellhead. The required flexibility and resiliency of the shock absorbing blocks is determined through a dynamic analysis which considers the inertial properties and flexibilities of the impacting masses that are involved. Since the equipment which lands on the wellhead is freely tethered, the impact loads on the wellhead may be applied from any direction, for example, horizontal, vertical, or a combination of both. The supporting guide structure comprising the present invention is flexibly and resiliently attached to the wellhead and is supported in a vertical direction by shock absorbing blocks which isolate the generally conical outer structure from the wellhead itself.

Accordingly, it is an important object of the present invention to provide improved means for shielding a subsea wellhead from and for mitigating the shocks or loads applied thereto.

Another object of the present invention is to provide improved subsea wellhead shock mitigating means for loads applied to the wellhead from any direction.

Still another object of the present invention is to provide a shield for mitigating vertical impact loads applied to a subsea wellhead.

Still another object of the present invention is to provide an improved subsea wellhead shock mitigating system that utilizes a shock absorbing material for minimizing lateral impact loads applied thereto.

With the above and other objects of this invention in view, the invention consists in the novel construction, arrangement and combination of various devices, elements and parts, as set forth in the claims hereof, one embodiment of the same being illustrated in the accompanying drawings and described in the specification.

BRIEF DESCRIPTION OF THE DRAWING

For a fuller understanding of the nature and objects of the invention reference should be had to the following detailed description, taken in conjunction with the accompanying drawings, in which.

DESCRIPTION OF THE PREFERRED EMBODIMENT

Figure 1:
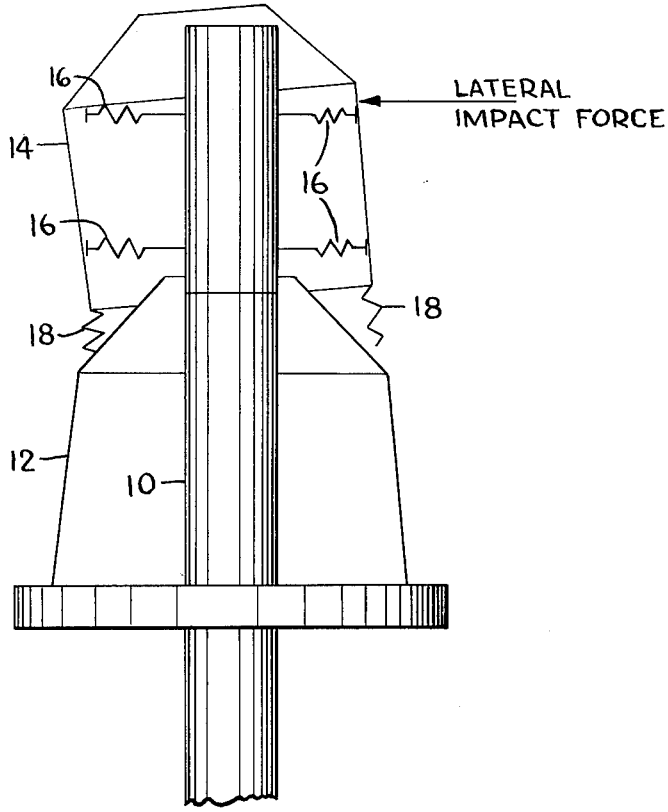
FIG. 1 is a schematic, elevational view illustrating the basic concept of the present invention.
Figure 2:
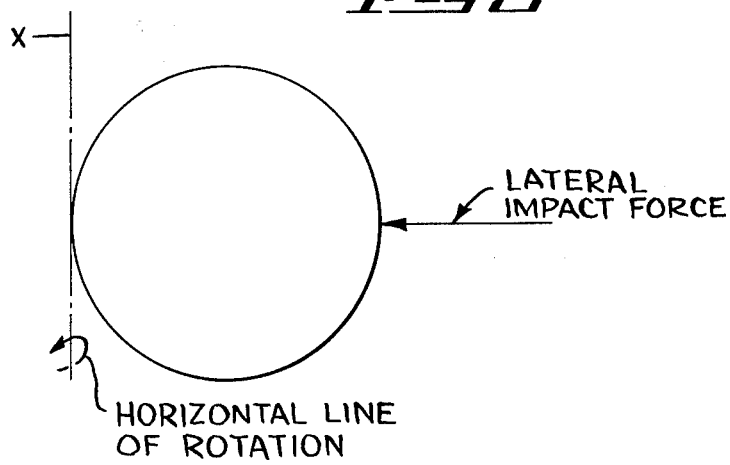
FIG. 2 is a plan view of the structure shown schematically in FIG. 1 for the purpose of illustrating the rotational effect of a lateral impact force against the structure comprising the present invention.

Reference may now be had to FIG. 1 and to FIG. 2 for an understanding of the theoretical aspect of the present invention. As shown for example in FIG. 1 there is provided a subsea wellhead 10 to which is rigidly secured a first, supporting guide structure 12. As will be described more fully hereinafter, a second outer structure 14 is resiliently and flexibly mounted on the first supporting structure 12 by means of resilient, shock absorbing, annular blocks 16 and 18. The second, outer structure 14 shields the wellhead 10 from vertical impact loads while the annular, resilient blocks 16 and 18 act as shock absorbers between the second, outer structure 14 and the wellhead 10 in order to minimize the harmful effects of lateral impact loads.

Under a lateral impact load separated from the center of rotation, such as shown in FIG. 2 for example, the second outer structure 14 will tend to rotate or pivot about a theoretical horizontal line of rotation labeled X in FIG. 2 which is tangent to and coincidental with the point of contact between the second, outer structure 14 and the first supporting guide structure 12. This rotation is resisted by a force that is required to accelerate the weight of the second, outer structure 14, by the force required to accelerate the weight of the sea water involved and by the force required to deform the shock absorbing blocks 16 and 18. The force reacting on the wellhead 10, is that which is transmitted by the shock absorbers 16 and 18. By properly sizing, by suitably selecting the material and by properly shaping the shock absorbers 16 and 18, the effects of the anticipated maximum impact load can be reduced to an acceptable value.

It should be noted at this time that the shock absorbing blocks 16 and 18 isolate the outer structure 14 from the wellhead 10. The shock absorbing blocks 16 and 18 are made from a flexible and resilient material having high damping characteristics such as neoprene. The shock absorbing blocks 16 and 18 are sized and shaped to obtain the desired flexibility for impact mitigation.

As will be explained more fully hereinafter, the second, outer structure 14 is flexibly attached to the wellhead 10 and is supported vertically by means of the upper shock absorber block 16 shown in FIG. 1 until such time as the wellhead 10 is installed on the well. At that time the second outer structure 14 becomes freely supported by the first guide structure 12.

Figure 3:
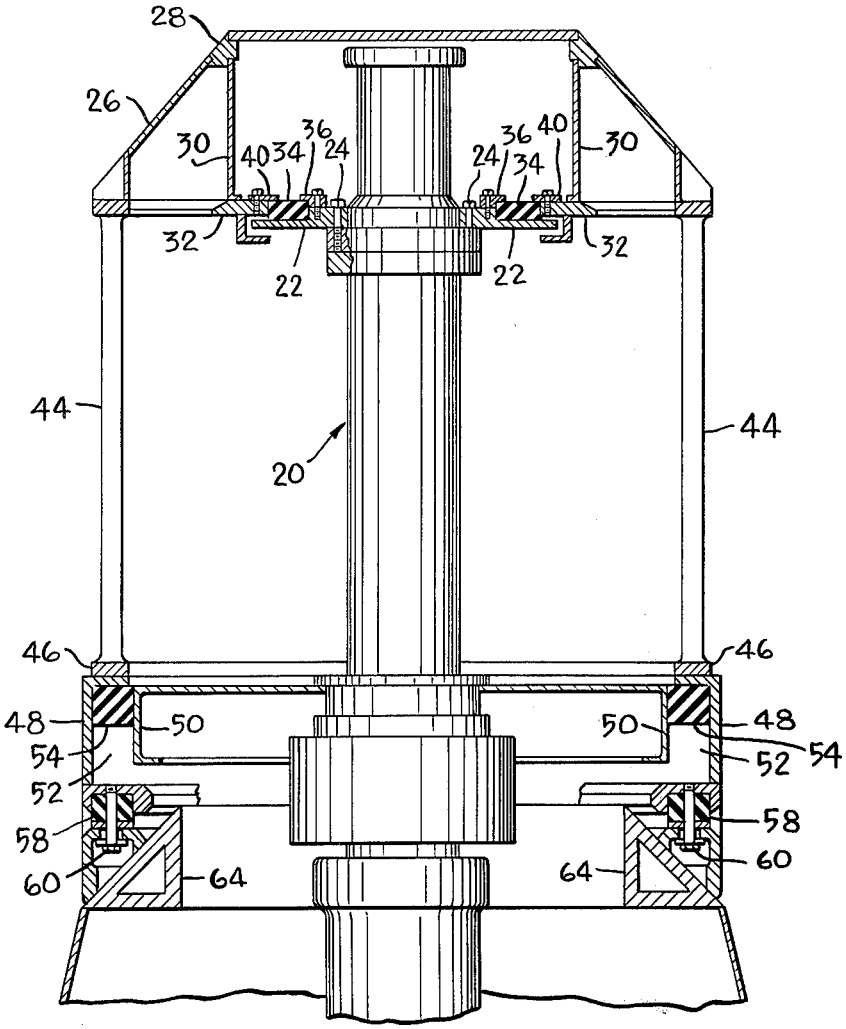
FIG. 3 is a fragmentary elevational view, partially in section and partially broken away, illustrating a portion of a typical subsea wellhead with the structure of the present invention applied thereto.
Figure 4:
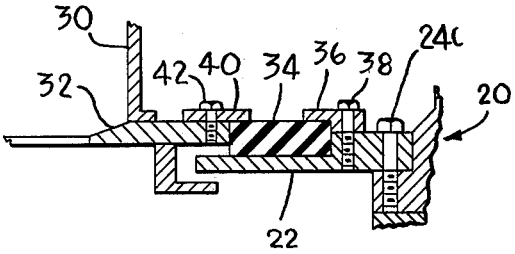
FIG. 4 is an enlarged, fragmentary sectional elevational view of a portion of the present invention shown in FIG. 3.

Reference may now be had to FIG. 3 for a better understanding of the application of the present invention. In the structure shown in FIG. 3, the wellhead is generally designated by the reference character 20 and corresponds to the wellhead 10 shown in FIG. 1. A first ring 22 is secured to the wellhead 20 by means of suitable fasteners 24 such as shown in FIG. 3 and in FIG. 4. An outer structure in the form of a cap 26 is suitably secured to a ring 28 by means of a sleeve 30. The lower end of the sleeve 30 is rigidly connected to a third ring 32 that is positioned concentrically about the wellhead 20. A first shock absorber 34, in the form of an annular member, is mounted on the first ring 22 and is secured thereto by a first annular clamp 36. A group of fasteners 38, extending through the annular clamp 36 secures the annular clamp 36 and the first shock absorber 34 to the first ring 22. A second retaining clamp 40 is secured to the third ring 32 by means of a plurality of fasteners 42.

The cap 26 is provided with a plurality of angularly spaced apart, downwardly depending columns 44 that terminate at their lower end in a fourth ring 46. A first, outer, sleevelike member 48 is rigidly secured to and depends downwardly from the fourth ring 46. A second sleeve 50, which is spaced radially inward of the first sleeve 48 defines an annular space 52 in which is positioned a second, annular shock absorber 54. The second inner sleeve 50 is suitably secured to the wellhead 20 such as by welding.

Generally, the cap 26 and columns 44 taken together correspond to the structure 14 shown in FIG. 1.

Figure 5:
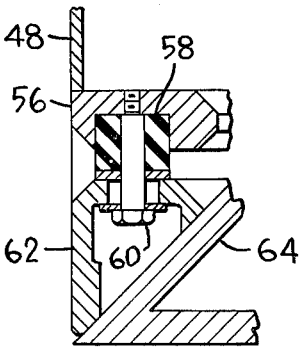
FIG. 5 is an enlarged, fragmentary sectional elevational view illustrating another portion of the present invention which is shown in FIG. 3.

As shown best in FIG. 5, the lower end of the first, outer sleeve 48 terminates at and is secured to a fifth ring 56 in which is mounted a third annular, resilient shock absorbing member 58. The member 58 corresponds to the shock absorbing block 18 shown in FIG. 1. A plurality of fasteners 60 extend through a portion of a supporting guide structure 62 for capturing the third shock absorber 58, as shown in FIG. 5. The supporting guide structure 62 is rigidly secured by any suitable means to a well casing 64 which is permanently installed in the sea floor around the well production line. The well casing 64 corresponds to the first supporting guide structure 12 shown in FIG. 1.

We wish it to be understood that we do not desire to be limited to the exact detailed construction shown and described, for obvious modifications will occur to a person skilled in the art.

Having thus described the invention, what we claim as new and desire to be secured by Letters Patent, is as follows:

1. A subsea wellhead shielding and shock mitigating system for use with a subsea wellhead, comprising:

a. a first supporting guide structure adapted to be secured to the wellhead in at least partially surrounding relationship;

b. a second, outer structure operative to be pivotally secured to said first structure and adapted to enclose the wellhead; and c. biasing means disposed between said second outer structure and said wellhead for biasing them with respect to each other, whereby the wellhead is shielded by said first and said second structures against impact from objects.

2. The system according to claim 1 further including resilient means disposed between said first structure and said wellhead and operative to absorb mechanical shocks to said first structure.

3. The system according to claim 2 wherein said resilient means comprises a ring-shaped member.

4. The system according to claim 1 wherein said second structure includes an upper section that is at least partially conical and which is positioned above the wellhead.

5. The system according to claim 1 wherein said biasing means comprises at least one resilient, ring-shaped member that is in contact with said second structure and the wellhead.

6. The system according to claim 1 wherein said biasing means comprises two ring-shaped members spaced apart axially from each other relative to the axis of the wellhead and in contact with said second structure and the wellhead.

* * * * *